US009498702B2

(12) United States Patent
Franco Munoz

(10) Patent No.: US 9,498,702 B2
(45) Date of Patent: Nov. 22, 2016

(54) BALL WHIRLING DEVICE FOR RECREATIONAL GAMES OF CHANCE

(71) Applicants: PROINDUMAR, S.L., Madrid (ES); Jesus Franco Munoz, Madrid (ES)

(72) Inventor: Jesus Franco Munoz, Madrid (ES)

(73) Assignees: PROINDUMAR, S.L., Madrid (ES); Jesus Franco Munoz, Madrid (ES)

( * ) Notice: Subject to any disclaimer, the term of this patent is extended or adjusted under 35 U.S.C. 154(b) by 0 days.

(21) Appl. No.: 14/443,793

(22) PCT Filed: Nov. 19, 2012

(86) PCT No.: PCT/ES2012/000284

§ 371 (c)(1),
(2) Date: May 19, 2015

(87) PCT Pub. No.: WO2014/076323

PCT Pub. Date: May 22, 2014

(65) Prior Publication Data

US 2015/0273319 A1 Oct. 1, 2015

(51) Int. Cl.

| | |
|---|---|
| ***A63F 11/00*** | (2006.01) |
| ***A63F 7/04*** | (2006.01) |
| ***G07C 15/00*** | (2006.01) |

(52) U.S. Cl.
CPC ..... *A63F 7/048* (2013.01); *G07C 15/001* (2013.01); *A63F 11/0002* (2013.01)

(58) Field of Classification Search
CPC ..... A63F 7/048; A63F 11/0002
USPC ..... 273/144 R, 144 A, 144 B, 138.3
See application file for complete search history.

(56) References Cited

U.S. PATENT DOCUMENTS

| | | | | |
|---|---|---|---|---|
| 3,140,875 | A | 7/1964 | Abbott et al. | |
| 5,738,350 | A * | 4/1998 | Lai | A63F 7/048 273/139 |
| 2009/0001663 | A1 | 1/2009 | Franco Munoz | |

FOREIGN PATENT DOCUMENTS

| | | |
|---|---|---|
| ES | 2163370 A1 | 1/2002 |

OTHER PUBLICATIONS

International Search Report dated Aug. 6, 2013 for PCT/ES2012/000284 and English translation.

* cited by examiner

*Primary Examiner* — Benjamin Layno
(74) *Attorney, Agent, or Firm* — Lucas & Mercanti, LLP

(57) ABSTRACT

The invention consists of eliminating the inner central shaft of the drum in order to allow a more homogenous mixing of the balls such that the chances of the balls being winning balls are not dependent on the position that they may occupy before the drum is rotated. To that end, the ball mixing blades (9) are integrally attached to the inner face of the structure of the drum. Not only does this structure allow mixing the balls better, but it also simplifies maintenance work on the device, in that it includes respective outer shafts (3) that are easily accessible without having to disassemble the drum in the event that the pin that links it with the mechanism for driving the rotation of the drum breaks.

8 Claims, 2 Drawing Sheets

BALL WHIRLING DEVICE FOR RECREATIONAL GAMES OF CHANCE

CROSS REFERENCE TO RELATED APPLICATIONS

This Application is a 371 of PCT/ES2012/000284 filed on Nov. 19, 2012, application which is incorporated herein by reference.

OBJECT OF THE INVENTION

The present invention relates to a ball whirling device of a drum, particularly designed for being used in recreational games for winning prizes.

The object of the invention is to provide a device that assures perfect mixing of the balls so that a ball located along the periphery of the drum has the same probabilities of being a winning ball as one that is located in the inner or middle area of said drum.

Another object of the invention is to provide a simpler structure than those that have existed up until now such that in case of a breakdown, a quicker and easier repair operation is possible.

BACKGROUND OF THE INVENTION

In the scope of the practical application of the invention, recreational games of chance are known to include an automatic whirling device that can mix and identify balls, comprising a frame provided with means for holding a drum, within which there is introduced a plurality of balls, provided with a central rotating shaft provided with means for driving the drum, and in which blades are established in the radial direction for mixing the balls, such that the mentioned drum incorporates a hole for translational movement located on the perpendicular bisector of the axis of rotation of the drum associated with a mechanism or assembly for displaying-collecting the balls, suitable for being fixed to the drum in the area of said hole, having a display basket outside the drum the opening of which faces the mentioned hole and is suitable for collecting a ball from the drum when said basket, and accordingly the drum, reach the lowermost position, such that opposite said lowermost point the game has means for reading the ball for the identification thereof and then returning it to the drum.

The existence of the mentioned shaft in the middle area of the drum makes it an obstacle for mixing the balls, which negatively affects their mixing.

It has experimentally been found that when the basket is located at its uppermost point, the balls, which can be seen at all times, that are located on the sides of the drum have very few chances of falling into the basket and therefore be winning balls, such that the player will never bet on these balls, the probabilities of game success increasing against the "theoretical" probabilities for which said game was designed, with the subsequent negative effect this entails.

Similarly, it has been experimentally found that after a long use period such drums can have mechanical problems, such as the pins linking the main shaft with the shaft of the drive system breaking, such that the mentioned shaft, and accordingly the drum, must be disassembled to replace said pin, which is clearly undesirable, difficult and complicated work.

DESCRIPTION OF THE INVENTION

The ball whirling device for recreational games of chance proposed by the invention solves in a fully satisfactory manner the drawbacks described above as a result of a simple but highly effective structure.

To that end, and more specifically, starting from the aforementioned basic structure, it has been envisaged that the drum not have the central shaft, this space being free for the balls to move around therein, considerably helping to mix them, such that the lateral ends of said drum include respective bearings or outer shafts, one of which is associated with a drive system for the whirling thereof, and the other one is a conventional position sensor to detect the position of the drum.

According to this new structure, the ball mixing blades are integrally attached to the inner face of the structure of the drum, being able to adopt a radial arrangement, i.e., being contained in a plane passing through the geometric center of the drum, or having a slight inclination with respect to said plane, without affecting the essence of the invention.

It has been envisaged that there are involved at least two blades in the device of the invention arranged on the imaginary horizontal midplane that is defined when the basket reaches its uppermost point or lowermost point, antisymmetrically opposite one another, even though said number of blades could be increased, there being involved another blade associated with the surface of the drum opposite which the basket is located.

Accordingly, and based on this structure, the inexistence of a central shaft allows mixing the balls better, assuring that all of them have the same chances of being collected in the mentioned basket, regardless of the position in which they may be located when said basket reaches the uppermost point, in which the balls remain immobile and can be seen by the player.

Similarly, and in the event that the pin of the drive system associated with the drum breaks, given that the shaft of said drum is an outer shaft instead of an inner shaft in this case, it allows the pin to be replaced by means of direct access to the drive system, without having to disassemble the drum, which implies a very quick and simple operation as opposed to what usually happens.

Finally, it should be pointed out that the body of the drum could be spherical or preferably slightly elongated in the horizontal direction given that since it is intended for being implemented in a recreational game, it cannot have excessively large dimensions, such that said configuration which is slightly prolonged in the longitudinal direction allows better adaptation to the dimensions of the game.

DESCRIPTION OF THE DRAWINGS

To complement the description that will be provided below and for the purpose of helping to better understand the features of the invention, according to a preferred practical embodiment thereof, a set of drawings is attached as an integral part of said description in which the following is depicted with an illustrative and non-limiting character.

PREFERRED EMBODIMENT OF THE INVENTION

Figure 1:
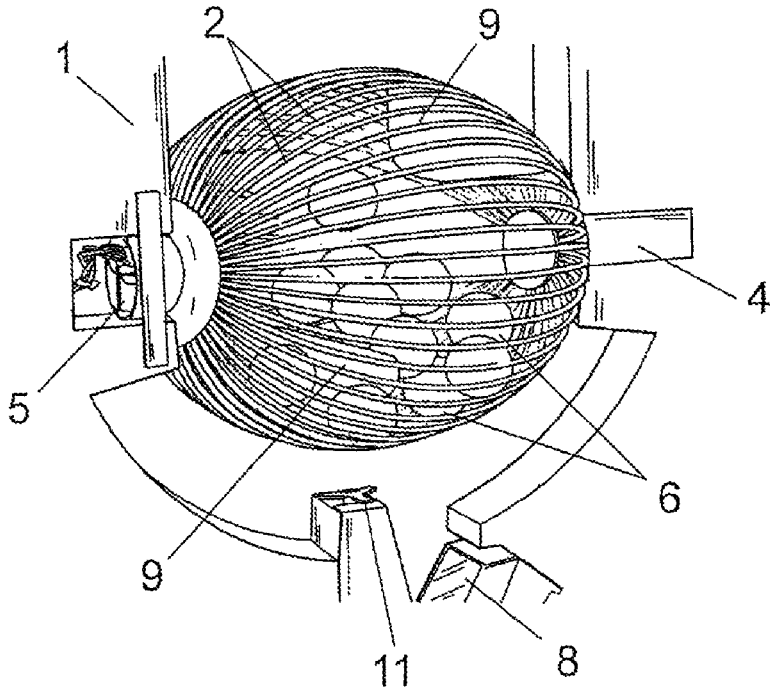
FIG. 1 shows a perspective view of a ball whirling device for recreational games carried out according to the object of the present invention, in which the drum is shown in an intermediate rotation position for same.
Figure 2:
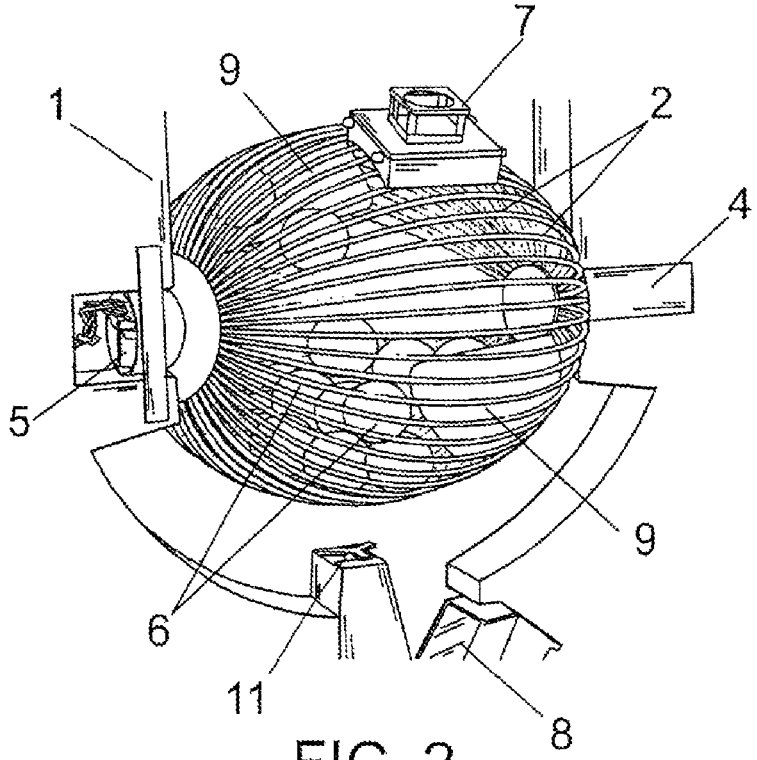
FIG. 2 shows a view similar to that of FIG. 1, but in which the drum is shown in a position close to the uppermost position envisaged for the basket of the drum.
Figure 3:
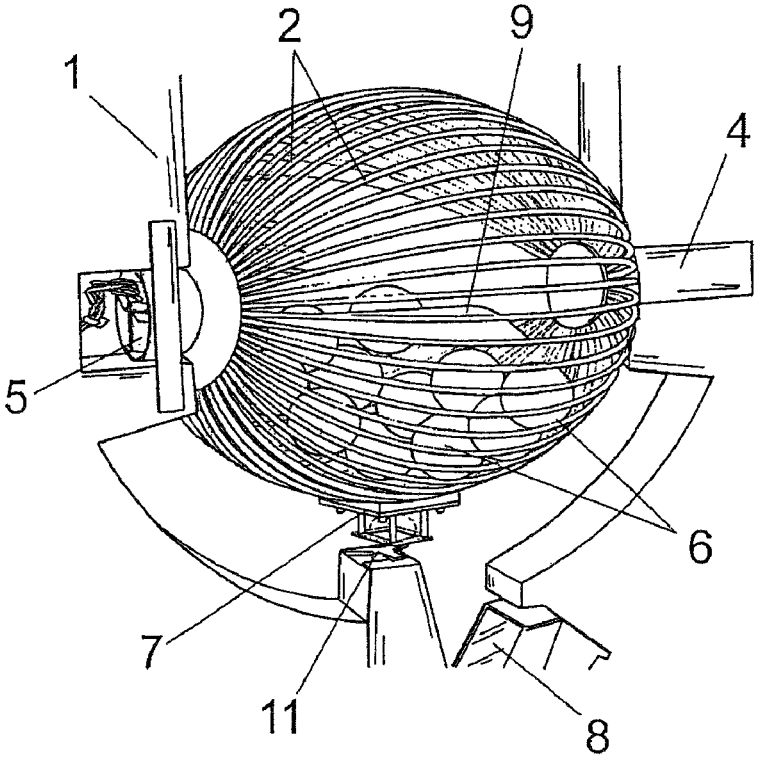
FIG. 3 shows a view similar to that of the previous figures but corresponding to the lowermost position for the basket of the drum.
Figure 4:
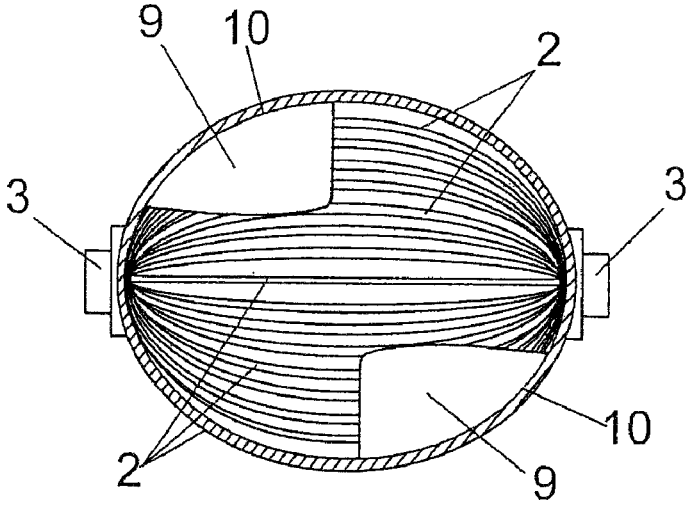
FIG. 4 finally shows a section view of the drum at the level of the blades included therein.

As can be seen in the aforementioned drawings, the proposed device is intended for being incorporated in the frame (1) of a recreational game of chance, having a cage-like drum (2), the lateral ends of which end in respective outer shafts (3) associated with a sensor for detecting the angular position of the drum (5) and with an actuating drive system (4) thereof, associated with electronic control elements for starting, stopping and changing the rotational direction of said drive mechanism.

Within the drum (2) there is arranged a plurality of drawing balls (6) the surface of which comprises a graphic depiction enabling the player to identify the ball in question, as well as means or codes for the actual game to identify the ball.

The drum (2) includes a hole for translational movement located on the perpendicular bisector of the imaginary axis of rotation of the drum associated with a mechanism assembly for displaying-collecting the balls (6) in the form of a basket (7) responsible for collecting the ball, and conventionally including a mechanism in the form of a half-closed top, not shown in the drawings, with an inlet opening such that when the drum rotates in one direction it rejects the balls hitting against said mechanism, whereas when it rotates in the opposite direction it allows receiving one of the balls (6) in the basket.

A reader (8) for reading the balls is established therebelow through which the game identifies the winning ball and acts accordingly. This element can be in many different forms, such as a barcode reader, a camera and number recognition software, or any other means considered appropriate.

According to another one of the features of the invention, the drum is provided with a series of blades (9) for mixing the balls (6), which are two in number in the chosen embodiment, although said number could be increased without affecting the essence of the invention.

These blades (9) are integrally attached to the inner face of the structure of the drum either by adhesive means (10) associated with one of the perimetral rings (2) thereof, or by any other conventional means, being able to adopt a radial arrangement, i.e., being contained in a plane passing through the geometric center of the drum, or having a slight inclination with respect to said plane.

The configuration and shape of the blades (9) may vary according to different design lines, although they will preferably have a large enough surface to provide suitable mixing of the balls, and small enough to not be an excessive obstacle when the balls drop towards the basket (7) due to gravity.

As regards the reader (8) for reading the balls (6), in the chosen practical embodiment said reader (9) is a static barcode reader, although it could also be a dynamic reader, such that for this specific case chosen as merely an example, it has been envisaged that in correspondence with the display area of the ball coinciding with the lowermost point for positioning the basket (7) there is established a motor-driven mechanism associated with a propeller (11), the vanes of which make contact with the ball housed in the basket (7), rotating it until the ball is read correctly.

If the said reading and identification of the ball does not take place, it may be because two balls tried to enter the basket (7) at the same time, becoming jammed and the basket accordingly being empty, for which purpose it has been envisaged that in the event of being unable to read the ball due to said ball being absent, the control circuit of the device causes limited back and forth movement, unjamming the balls and said balls therefore being able to enter the mentioned basket (7) with a very clean operation that prevents the player from becoming untrusting of the game.

The configuration of the drum can vary such that it can be spherical or preferably slightly elongated in the horizontal direction, as shown in the example depicted in the drawings.

The invention claimed is:

1. A ball whirling device for recreational games of chance, comprising:

a drum comprising a plurality of perimetral rings, a first lateral end coupled to a first outer shaft, a second lateral end coupled to a second outer shaft, and a hole adapted to allow a ball to pass between an inside of the drum and an outside of the drum;

an actuating drive system adapted to actuate the drum, the actuating drive system being connected to the first outer shaft;

a sensing device adapted to sense a position of the drum, the sensing device being connected to the second outer shaft;

a plurality of drawing balls disposed in the drum;

a basket for displaying a winning ball, being disposed proximate the hole, such that when a particular drawing ball passes from the inside of the drum to the outside of the drum, the particular drawing ball enters the basket; and a plurality of blades disposed in the inside of the drum, the plurality of blades being adapted to mix the plurality of drawing balls, wherein each of the plurality of blades is integrally attached to a respective perimetral ring of the drum and is disposed in one of a first plane that comprises a point at a geometric center of the drum and a second plane slightly inclined with respect to the first plane.

2. The ball whirling device for recreational games of chance according to claim 1, comprising two blades disposed in the inside of the drum.

3. The ball whirling device for recreational games of chance according to claim 2, wherein the two blades are arranged antisymmetrically with respect to an axis of rotation of the drum.

4. The ball whirling device for recreational games of chance according to claim 1, wherein the drum has a spherical shape.

5. The ball whirling device for recreational games of chance according to claim 1, wherein the drum has a shape of a sphere that is elongated in horizontal direction along an axis defined by the first and second outer shafts.

6. The ball whirling device for recreational games of chance according to claim 1, further comprising a reader device for reading the balls, wherein the reader device is one of a dynamic barcode reader and a static barcode reader adapted to identify a code on a surface of a respective ball.

7. The ball whirling device for recreational games of chance according to claim 6, wherein the reader is a static reader;

the ball whirling device further comprising:

a motor-driven mechanism comprising a propeller adapted to control a position of a particular drawing ball in the basket, point wherein the motor-driven mechanism is disposed at a location defined by a lowest point associated with the basket.

8. The ball whirling device for recreational games of chance according to claim 6, wherein the control circuit of the device is adapted to cause a back and forth movement of the drum in response to a determination that due to an absence of a ball in the reader device, a reading of the ball is not possible.

* * * * *